United States Patent [19]

Aihara

[11] Patent Number: 5,049,052

[45] Date of Patent: Sep. 17, 1991

[54] LIGHT WEIGHT VANE-TYPE ROTARY COMPRESSOR

[75] Inventor: Toshinori Aihara, Kanagawa, Japan

[73] Assignee: Atsugi Motor Parts Company, Limited, Kanagawa, Japan

[21] Appl. No.: 337,350

[22] Filed: Apr. 13, 1989

[30] Foreign Application Priority Data

Apr. 14, 1988 [JP] Japan ..... 63-50523[U]

[51] Int. Cl.[5] ..... F04C 2/344

[52] U.S. Cl. ..... 418/179

[58] Field of Search ..... 418/83, 179

[56] References Cited

U.S. PATENT DOCUMENTS

| | | | |
|---|---|---|---|
| 3,096,932 | 7/1963 | Traylor | 418/179 X |
| 4,492,540 | 1/1985 | Yamamoto | 418/179 X |
| 4,815,953 | 3/1989 | Iio | 418/179 |
| 4,898,526 | 2/1990 | Sakamaki et al. | 418/259 |
| 4,917,584 | 4/1990 | Sakamaki et al. | 418/256 |

FOREIGN PATENT DOCUMENTS

| | | | |
|---|---|---|---|
| 67989 | 4/1983 | Japan | 418/179 |
| 219484 | 11/1985 | Japan | 418/179 |
| 8383 | 1/1989 | Japan | 418/179 |
| 41691 | 2/1989 | Japan | 418/179 |

*Primary Examiner*—Leonard E. Smith

*Attorney, Agent, or Firm*—Bachman & LaPointe

[57] ABSTRACT

A vane-type rotary compressor employs a cam ring made of an aluminium type metal which is different from the metal to form a rotor and rotor vanes and has a linear expansion coefficient selected to be greater than that of the metal of the rotor and vanes so as to compensate temperature difference therebetween.

13 Claims, 3 Drawing Sheets

LIGHT WEIGHT VANE-TYPE ROTARY COMPRESSOR

BACKGROUND OF THE INVENTION

1. Field of the Invention

The present invention relates generally to a vane-type rotary compressor, applicable for such as an automotive air conditioner system. More specifically, the invention relates to a light weight vane-type rotary compressor which is free from influence of heat.

2. Description of the Background Art

Japanese Patent First (unexamined) Publication (Tokkai) Showa 61-89991 discloses a light weight vane-type rotary compressor. In order to reduce the weight of the assembly, the principle components, i.e. cam ring, rotor and an inlet-side side plate are formed of aluminium-type metal. A compressor mechanism comprising the rotor, vane, can ring and so forth, is housed within a cover shell in order to suppress variation of substantially small clearance between the cam ring and the rotor. Namely, as is well known, the cam ring defines an essentially oval or elliptic rotor receptacle opening in order to house the rotor which carries a plurality of rotor vanes. The rotor is supported by a rotor shaft which is driven by a drive, such as an automotive internal combustion engine and disposed in the rotor receptacle opening of the cam ring to define a substantially small clearance at the smallest diameter section. The rotor vanes are received within radial grooves formed in the rotor and moves toward and away from the inner periphery of the rotor receptacle opening to establish fluid tight seal and thus to define pressure chambers. The rotor is cooperative with the the inner periphery of the rotor receptacle opening for varying the volume of the pressure chamber over each cycle of rotor revolution to repeat compressor cycles which includes strokes of induction, compression and discharge.

With such construction, because the aluminium type metal has relatively large thermal expansion coefficient, the clearance can vary due to temperature difference between the rotor and cam ring. Namely, compressing the fluid in the compression stroke, heat is generated which raises the temperature of the cam ring and the rotor. When the cam ring is exposed to the atmosphere, the heat transferred to the cam ring is radiated. On the other hand, since the rotor is enclosed in the rotor receptacle opening in the cam ring, it may cause thermal expansion much greater than that caused in the cam ring.

In the above-identified prior publication, the cam ring and rotor are formed of a the aluminium type metal or metals having substantially the same linear expansion coefficient. The assembly of the compressor mechanism is enclosed in the shell cover so as to reduce radiation of the heat from the cam ring so as to minimize temperature difference between the cam ring and the rotor. With such construction, the shell cover may cause increasing weight which is against the task for reduction of the weight of the unit. Furthermore, the shell cover may incur additional cost to cause rising of the production cost. However, the shell cover is regarded as inevitable component because exposure of the cam ring to the atmosphere may cause substantial temperature difference between the can ring and the rotor, which temperature difference may cause contact between the outer periphery of the rotor and the inner periphery of the rotor receptacle opening of the cam ring. This may cause burning on of the rotor onto the cam ring.

SUMMARY OF THE INVENTION

Therefore, it is an object of the present invention to provide a vane-type rotary compressor which can solve the drawbacks in the prior art.

Another object of the present invention is to provide a vane-type rotary compressor which can avoid necessity of the shell cover without causing substantial influence of the temperature difference of a rotor and a cam ring.

A further object of the invention is to provide a vane-type rotary compressor which is inexpensive and achieving satisfactory reduction of the weight of assembly.

In order to accomplish aforementioned and other objects, a vane-type rotary compressor, according to the present invention, employs a cam ring made of an aluminium type metal which is different from the metal to form a rotor and rotor vanes and has a linear expansion coefficient selected to be greater than that of the metal of the rotor and vanes.

According to one aspect of the invention, a vane-type rotary compressor comprises:

a rotor drivingly associated with a driving power source to be driven to rotate;

a cam ring assembly defining an enclosed non-circular opening, in which said rotor is disposed to define a clearance which varies between a minimum clearance and a maximum clearance at different sections, said cam ring assembly including a cam ring body;

a plurality of vane carried by said rotor and extending radially for radial movement toward and away from the inner periphery of said opening for defining a plurality of pressure chambers, each pressure chamber varying volume to increase during induction stroke and to decrease during compressing and discharging stroke according to variation of clearance;

induction means, communicated with said pressure chamber, for supplying a fluid to be pressurized into said pressure chamber in said induction stroke;

discharge means, communicated with said pressure chamber, for discharging pressurized fluid in said pressure chamber in said compressing and discharge stroke; and said rotor, cam ring assembly and said vanes are formed with light weight materials, in which at least said cam ring body is formed of a light weight material having greater linear expansion coefficient in thermal expansion than that of remaining components made of light weight material.

The cam ring body may have an external periphery exposed to an atmosphere to radiate a heat created during compressor operation. The light weight material may be a light metal. Preferably, the light metal is an aluminium type metal.

On the other hand, the cam ring body may be made of a light weight material having a linear expansion coefficient which is greater than the light weight material of said rotor for compensating temperature difference between said cam ring body and said rotor. The cam ring assembly further comprises a pair of side plates closing both axial ends of said cam ring body, and material of said side plates and material of said rotor are so selected as to maintain a predetermined clearance therebetween.

According to another aspect of the invention, a vane-type rotary compressor for an automotive air conditioner system, comprises:

a rotor drivingly associated with an automotive engine to be driven for rotation at a rotation speed corresponding to revolution speed of said engine;

a cam ring assembly defining an enclosed non-circular opening, in which said rotor is disposed to define a clearance which varies between a minimum clearance and a maximum clearance at different sections, said cam ring assembly including a cam ring body;

a plurality of vanes carried by said rotor and extending radially for radial movement toward and away from the inner periphery of said opening for defining a plurality of pressure chambers, each pressure chamber varying volume to increase during induction stroke and to decrease during compressing and discharging stroke according to variation of clearance;

induction means, communicated with said pressure chamber, for supplying a fluid to be pressurized into said pressure chamber in said induction stroke;

discharge means, communicated with said pressure chamber, for discharging pressurized fluid in said pressure chamber in said compressing and discharge stroke; and said rotor, cam ring assembly and said vanes are formed with light weight materials, in which at least said cam ring body is formed of a light weight material having greater linear expansion coefficient in thermal expansion than that of remaining components made of light weight material.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
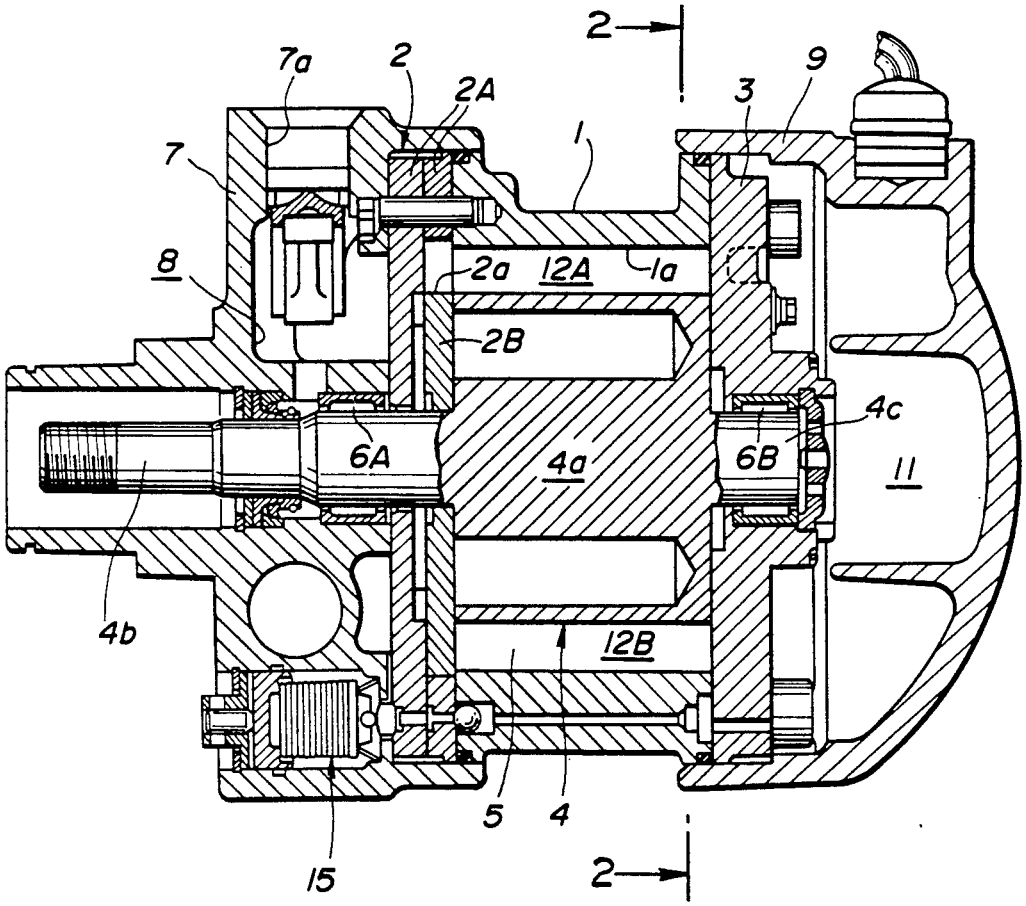
FIG. 1 is a longitudinal section of the preferred embodiment of a vane-type rotary compressor according to the present invention.
Figure 2:
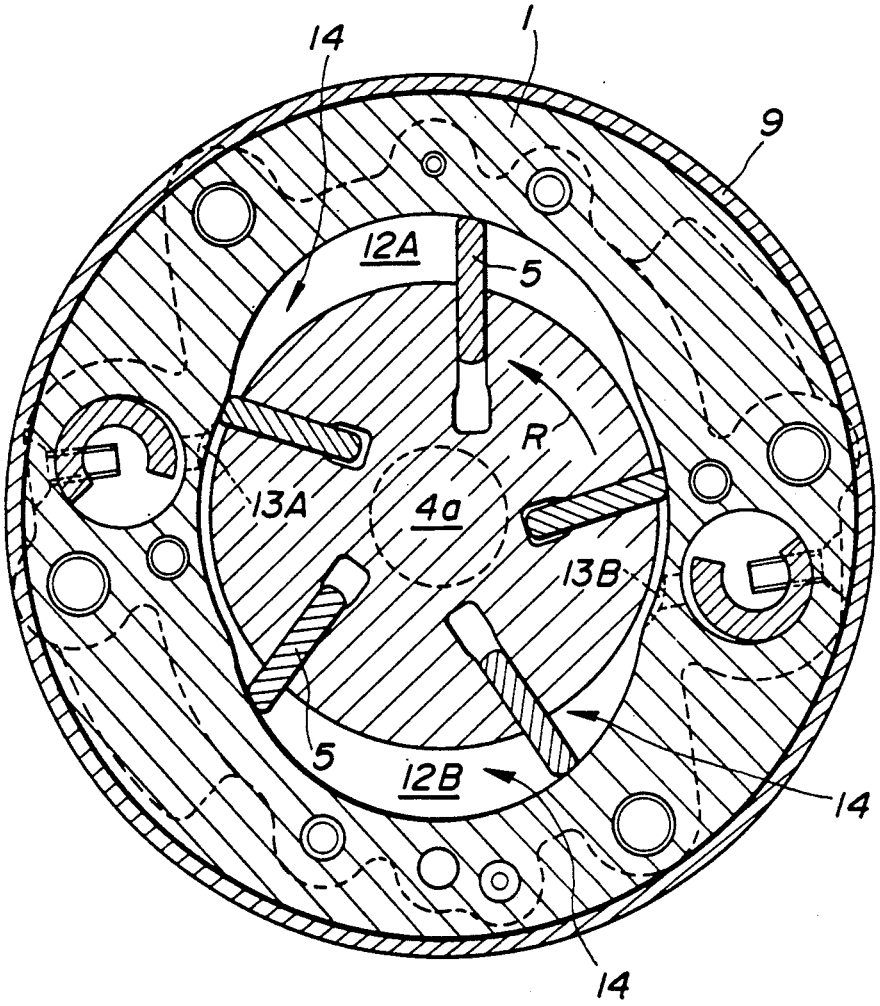
FIG. 2 is a section taken along line II—II of FIG. 1.

Referring now to the drawings, particularly to FIGS. 1 and 2, the preferred embodiment of a vane-type rotary compressor has a cam ring 1 defines a rotor receptacle opening 1*a* of essentially oval or elliptic configuration. The rotor receptacle opening 1*a* opens at both front and rear axial ends. Front and rear side plates 2 and 3 are secured onto both axial ends of the cam ring 1. A rotor 4 defining a plurality of radially extending grooves for receiving rotor vanes 5 therein in slidable fashion, is rotably disposed within the rotor receptacle opening 1*a*. The rotor 4 comprises an essentially cylindrical main body 4*a* and cylindrical shaft sections 4*b* and 4*c* axially extending from both of front and rear axial ends of the main body. The cylindrical shaft sections 4*b* and 4*c* extends through the front and the rear side plates 2 and 3 and rotatably supported by means of bearings 6A and 6B. The cylindrical shaft section 4*b* is connected to a driving power source, such as an automotive internal combustion engine, via an appropriate power train, such as pulley and belt. On the other hand, the main body 4*a* of the rotor 4 has front and rear end planes opposing to the inner planner surfaces of the front and rear side plates 2 and 3 with substantially small clearances defined therebetween. The clearance between the axial end faces of the rotor and the mating surfaces of the front and the rear side plates 2 and 3 will be hereafter referred to as "side clearance". On the other hand, the rotor 4 has the circumferential surface opposing to the inner periphery of the rotor receptacle opening 1*a* of the cam ring 1 with a clearance. The clearance between the circumferential circuit of the rotor and the inner periphery of the rotor receptacle opening will be hereafter referred to as "top clearance." The top clearance varies to be maximum at the largest diameter section of the elliptic rotor receptacle opening and minimum at the smallest diameter section. The rotor is formed with a pressurized fluid path in a known manner to supply a pressurized fluid to the bottom portion of the radially extending grooves for exerting a fluid pressure to the associated rotor vanes 5 for constantly establishing fluid tight contact between the tip end of the rotor vanes 5 and the inner periphery of the rotor receptacle opening 1*a* for defining a plurality of pressure chambers 12A, 12B . . . in an annular chamber 14 formed between the outer periphery of the rotor 4 and the inner periphery of the rotor receptacle opening 1*a*.

The cam ring 1 is formed with an inlet 13A and an outlet 13B. Respective of the inlet 13A and the outlet 13B open at the smallest diameter section. The induction port 13A is communicated with an induction chamber 8 which is defined between the front side plate 2 and a front cover 7 and communicated with an induction port 7*a* formed through the front cover 7. The outlet 13B is in fluid communication with a discharge chamber 11 which is defined between the rear side plate 3 and a rear cover 9. The discharge chamber 11 is in fluid communication with a discharge port 9*a* defined through the rear cover.

In case that the shown embodiment of the vane-type rotor compressor is employed in an automotive air conditioner system, the inlet port 7*a* is connected to an external evaporator (not shown) and the discharge port 9*a* is connected to an external condenser.

In the shown embodiment, the front side plate 2 comprises an annular stationary plate 2A which is rigidly secured onto the front axial end of the cam ring 1 by means of a fastening bolt or screw, and a movable plate 2B rotatable about the rotation axis of the rotor and disposed radial inside of the stationary plate. The movable plate 2B is formed with a pair of cut outs 2*a*. The cut outs 2*a* selectively establish and block fluid communication by-passing between the induction chamber 8 and the pressure chamber 12A, 12B . . . according to the angular position of the movable plate 2B when the movable plate is driven to rotate by means of an actuator 15. This allows the amount of pressurized fluid discharged by the pump to be adjusted.

As shown in FIG. 2, the rotor 4 is driven by the driving torque transmitted through the cylindrical shaft section 4*a* in a direction indicated by an arrow R. During one cycle of rotation, each pressure chamber 12A, 12B . . . operates to introduce the fluid in an induction mode, compressing the fluid in the compression mode and discharging the pressurized fluid in the discharge mode. One compressor cycle is completed by sequence of operations of induction mode, compression mode and discharge mode.

The operation of the preferred embodiment of the rotary compressor according to the invention will be discussed in terms of application for the automotive air conditioner system. In such case, the rotor 4 is driven by the engine driving torque input through the cylindrical shaft section 4*b*. The rotor 4 is thus rotated in the direction R as shown in FIG. 2. During rotation, the volume of the pressure chamber 12A, 12B . . . increases gradually to create force for drawing the refrigerant from the induction chamber 8, during the induction stroke. Subsequently, the volume of the pressure chamber is gradually reduced to compress the refrigerant in the pressure chamber to increase the pressure of the refrigerant. The pressurized refrigerant is fed through the outlet 13B, the discharge chamber 11 and the discharge port 9*a* to the condenser.

By repeating the compression cycles set forth above, the rotor 4 and the cam ring 1 are heated by the heat created by compression of refrigerant. Since the rotor is driven by the engine, rotation speed is proportional to the engine revolution speed. Therefore, at the high engine speed range, the heat value created becomes greater to heat the rotor and the cam ring at higher temperature. On the other hand, when the vehicle is driven at high speed, the cam ring exposed to the atmosphere is subject to the relatively high rate air flow to cause lowering of the temperature to increase the temperature difference between the cam ring and rotor. If the material of the cam ring and the rotor is the same, the top clearance may be reduced to cause contacting of the rotor and cam ring.

In order to avoid this, the cam ring 1 and the rotor 4 are made of light metals, such as aluminium type metal with different linear expansion coefficient in causing thermal expansion. The metal forming the cam ring 1 is selected to have larger linear expansion coefficient than the metal for forming the rotor 4. On the other hand, the front and the rear side plates 2 and 3 and the rotor vanes 5 are formed of a light metal or metals or a synthetic resin. The material for forming the front and rear side plates 2 and 3 and the rotor vane 5 is also selected to have smaller linear expansion coefficient than the the metal for forming the cam ring 1.

The metal of the cam ring 1 is so selected as to maintain the top clearance and side clearance within a predetermined range, in relation to an initial setting of the top and side clearances.

Figure 3:
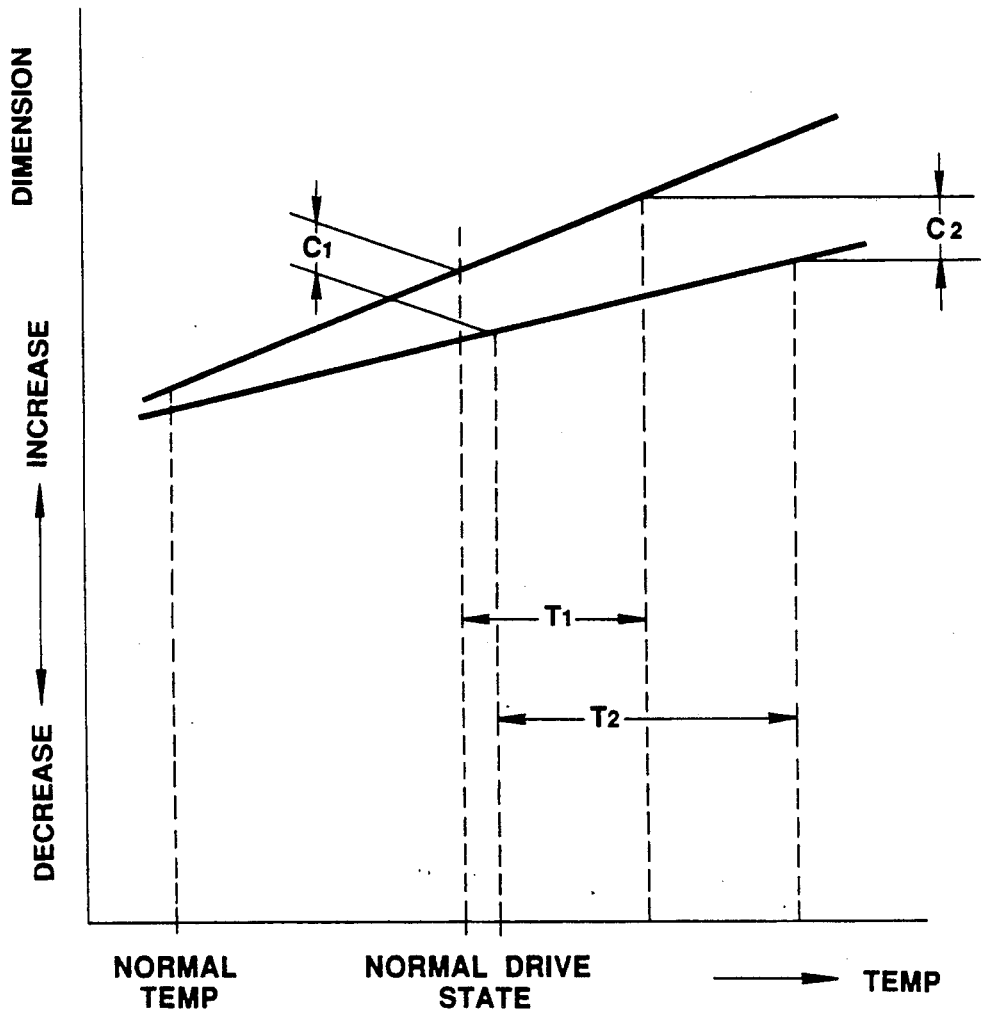
FIG. 3 is a graph showing variation of clearance in relation to variation of temperature.

The setting of the top and side clearance is done so that an optimum top and side clearance $C_1$ can be obtained at normal driving state, at which the temperature difference between the cam ring 1 and the rotor 4 is $t_1$. The metal of the cam ring 1 is so selected as to have the linear expansion coefficient in relation to the metal of the rotor 4 to maintain the top clearance at higher speed range. Namely, in the shown example of FIG. 3, when the vehicle speed is higher to cause rising of the temperature of the rotor in a magnitude of $T_2$, and when the cam ring 1 is subject cooling effect due to radiation of heat for lowering the rising magnitude of temperature at $T_1$ because the cam ring 1 is exposed to the atmosphere as shown in FIG. 1, the top clearance $C_2$ is maintained approximately equal to the optimum top clearance. At the vehicle low speed range, since the cam ring 1 is exposed, it is still subject air flow to be cooled for slightly lowering the temperature in comparison with the temperature of the rotor 4, the top clearance is slightly narrowed from the optimum clearance $C_1$ but maintained close thereto. The metal of the cam ring 1 and the metal of the rotor 4 is so selected as to maintain minimum top clearance $C_3$ at a normal temperature range where temperatures of the cam ring 1 and the rotor are equal to each other. Similarly, the metal of the rotor 1 is so selected as to have the linear expansion coefficient in relation to the metal or resin of the side plate 2 or 3 to maintain the side clearance even at higher speed range or the normal temperature range, as shown in FIG. 3. By providing the characteristics of variation of the top and side clearance as shown in FIG. 3, leakage of the fluid at the relatively low vehicle speed range can be successfully prevented.

In the practical embodiment, the cam ring 1 is made of high silicon-aluminium alloy containing silicon in a content of 16 Wt % to 18 Wt % and having the linear expansion coefficient of $18\times10^{-6}$/°C. The rotor is made of high silicon-aluminium alloy containing silicon in a content of 16 Wt % to 18 Wt % and iron in a content of 4 Wt % to 6 Wt %, and having the linear expansion coefficient in a range of $15\times10^{-6}$/°C. to $17\times10^{-6}$/°C. The side plates 2 and 3 are also made of high silicon-aluminium alloy containing silicon in a content of 16 Wt % to 20 Wt % and iron in a content of 4 Wt % to 6 Wt %, and and having the linear expansion coefficient in a range of $15\times10^{-6}$/°C. to $17\times10^{-6}$/°C. In the practical implementation of the invention utilizing the alloys set forth above, the variation characteristics of the top and side clearance in relation to the temperature as illustrated in FIG. 3 could be obtained.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. A vane-type rotary compressor comprising:

a rotor drivingly associated with a driving power source to be driven to rotate;

a cam ring assembly defining an enclosed non-circular opening, in which said rotor is disposed to define a top clearance which varies between a minimum clearance and a maximum clearance at difference sections, said cam ring assembly including a cam ring body having an external peripheral surface;

a plurality of vanes carried by said rotor and extending for radial movement toward and away from the inner periphery of said opening for defining a plurality of pressure chambers, each pressure chamber varying volume to increase during induction stroke and to decrease during compressing and discharging stroke according to variation of clearance of said vanes within said cam ring assembly;

front and rear side plates secured to the cam ring body for further defining said opening in which said rotor is disposed thereby defining a side clearance between said side plates and said rotor;

a front cover secured to said front side plate for defining an induction chamber between the front cover and the front side plate, said induction chamber being communicated with said pressure chamber for supplying a fluid to be pressurized into said pressure chamber in said induction stroke;

a rear cover secured to said rear side plate for defining a discharge chamber between the rear cover and the rear side plate, said discharge chamber being communicated with said pressure chamber for discharging pressurized fluid in said pressure chamber in said compressing and discharge stroke; and wherein the external peripheral surface of the cam ring body is exposed to an atmosphere to radiate heat created during the compressor operation, and said cam ring body is formed of a material having a higher coefficient of thermal expansion than the coefficients of thermal expansion of both the rotor and the vanes such that the top clearance is maintained in a predetermined range over all operating speeds of the compressor.

2. A vane-type rotary compressor comprising:

a rotor drivingly associated with a driving power source to be driven to rotate;

a cam ring assembly defining an enclosed non-circular opening, in which said rotor is disposed to define a top clearance which varies between a minimum clearance and a maximum clearance at different sections, said cam ring assembly including a cam ring body having an external peripheral surface;

a plurality of vanes carried by said rotor and extending radially for radial movement toward and away from the inner periphery of said opening for defining a plurality of pressure chambers each pressure chamber varying volume to increase during induction stroke and to decrease during compressing and discharging stroke according to variation of clearance of said vanes within said cam ring assembly;

induction means, communicated with said pressure chamber, for supplying a fluid to be pressurized into said pressure chamber in said induction stroke;

discharge means, communicated with said pressure chamber, for discharging pressurized fluid in said pressure chamber in said compressing and discharge stroke; and wherein the external peripheral surface of the cam ring body is exposed to an atmosphere to radiate heat created during the compressor operation, said cam ring body being formed of a material having coefficient of thermal expansion which is greater than the coefficient of thermal expansion of the material from which the rotor is formed such that the top clearance is maintained in a predetermined range over all operating speeds of the compressor.

3. A vane-type rotary compressor according to claim 2, wherein the coefficient of thermal expansion of the cam ring body is greater than the coefficients of thermal expansion of the vanes.

4. A vane-type rotary compressor according to claim 2 wherein side plates are secured to the cam ring body for further defining said opening in which said rotor is disposed thereby defining a side clearance between said side plates and said rotor wherein the material from which the side plates are formed has a coefficient of thermal expansion less than that of said cam ring body such that the side clearance is maintained in a predetermined range over all operating speed of the compressor.

5. A vane-type rotary compressor according to claim 4 wherein the cam ring is formed of a Al-Si alloy having a Si content of from about 16–18 wt. %; said rotor is formed of a Al-Si-Fe alloy having a Si content of from about 16–18 wt. % and and Fe content of from about 4–6 wt. %, and said side plates of formed from an AL-Si-Fe alloy having a Si content of from about 16–20 wt. % and an Fe content of from about 4–6 wt. %.

6. A vane-type rotary compressor according to claim 4 wherein the material from which said rotor and said side plates is formed has a coefficient of thermal expansion of from about $15\times10^{-6}/°C.$ to about $17\times10^{-6}/°C.$ and the coefficient of thermal expansion of the material from which the cam ring is formed is greater than the coefficient of thermal expansion of both the rotor and the side plates.

7. A vane-type rotary compressor according to claim 6 wherein the coefficient of thermal expansion of the material from which the cam ring is about $18\times10^{-6}/°C.$

8. A vane-type rotary compressor for an automotive air conditioner system, comprising:

a rotor drivingly associated with an automotive engine to be driven for rotation at a rotation speed corresponding to the revolution speed of said engine;

a cam ring assembly defining an enclosed non-circular opening, in which said rotor is disposed to define a top clearance which varies between a minimum clearance and a maximum clearance at different sections, said cam ring assembly including a cam ring body having an external peripheral surface;

a plurality of vanes carried by said rotor and extending radially for radial movement toward and away from the inner periphery of said opening for defining a plurality of pressure chambers, each pressure chamber varying volume to increase during induction stroke and to decrease during compressing and discharging stroke according to variation of clearance of said vanes within said cam ring assembly;

induction means, communicated with said pressure chamber, for supplying a fluid to be pressurized into said pressure chamber in said induction stoke;

discharge means, communicated with said pressure chamber, for discharging pressurized fluid in said pressure chamber in said compressing and discharge stroke; and wherein the external peripheral surface of the cam ring body is exposed to an atmosphere to radiate heat created during the compressor operation, said cam ring body being formed of a material having coefficient of thermal expansion which is greater than the coefficient of thermal expansion of the material from which the rotor is formed such that the top clearance is maintained in a predetermined range over all operating speeds of the compressor.

9. A vane-type rotary compressor according to claim 8 wherein side plates are secured to the cam ring body for further defining said opening in which said rotor is disposed thereby defining a side clearance between said side plates and said rotor wherein the material from which the side plates are formed has a coefficient of thermal expansion less than that of said cam ring body such that the side clearance is maintained in a predetermined range over all operating speed of the compressor.

10. A vane-type rotary compressor according to claim 8 wherein the material from which said rotor and said side plates is formed has a coefficient of thermal expansion of from about $15\times10^{-6}/°C.$ to about $17\times10^{-6}/°C.$ and the coefficient of thermal expansion of the material from which the cam ring is formed is greater thn the coefficient of thermal expansion of both the rotor and the side plates.

11. A vane-type rotary compressor according to claim 8 wherein the coefficient of thermal expansion of the material from which the cam ring is about $18\times10^{-6}/°C$.

12. A vane-type rotary compressor according to claim 8 wherein the cam ring is formed of a Al-Si alloy having a Si content of from about 16–18 wt. %; said rotor is formed of a Al-Si-Fe alloy having a Si content of from about 16–18 wt. % and an Fe content of from about 4–6 wt. %; said side plates are formed from an Al-Si-Fe alloy having a Si content of from about 16–20 wt. % and an Fe content of from about 4–6 wt. %.

13. A vane-type rotary compressor according to claim 8, wherein the coefficient of thermal expansion of the cam ring body is greater than the coefficients of thermal expansion of the vanes.

* * * * *

UNITED STATES PATENT AND TRADEMARK OFFICE

CERTIFICATE OF CORRECTION

PATENT NO. : 5,049,052

DATED : September 17, 1991

INVENTOR(S) : Toshinori Aihara

It is certified that error appears in the above-identified patent and that said Letters Patent is hereby corrected as shown below:

Column 8, claim 5, line 2, "and" second occurrence should read --an--.

Column 8, claim 5, line 3, "AL" should read --A1--.

Column 8, claim 8, line 41, "stoke" should read --stroke--.

Column 9, claim 10, line 2, "thn" should read --than--.

Signed and Sealed this

Twenty-third Day of February, 1993

*Attest:*

STEPHEN G. KUNIN

*Attesting Officer*

*Acting Commissioner of Patents and Trademarks*